US006183689B1

(12) United States Patent
Roy et al.

(10) Patent No.: US 6,183,689 B1
(45) **Date of Patent: *Feb. 6, 2001**

(54) PROCESS FOR SINTERING POWDER METAL COMPONENTS

(75) Inventors: Rustum Roy; Dinesh K. Agrawal; Jiping Cheng, all of State College, PA (US)

(73) Assignee: Penn State Research Foundation, University Park, PA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/185,246

(22) Filed: Nov. 3, 1998

Related U.S. Application Data

(60) Provisional application No. 60/066,947, filed on Nov. 25, 1997.

(51) Int. Cl.[7] ..... B22F 3/00

(52) U.S. Cl. ..... 419/38; 419/52

(58) Field of Search ..... 419/38, 52

(56) References Cited

U.S. PATENT DOCUMENTS

| | | | | |
|---|---|---|---|---|
| 4,501,717 | * | 2/1985 | Tsukamoto et al. | 419/58 |
| 4,719,078 | * | 1/1988 | Miyashita et al. | 419/53 |
| 5,110,542 | * | 5/1992 | Conaway | 419/25 |
| 5,397,530 | * | 3/1995 | Narasimhan et al. | 419/1 |
| 5,702,501 | * | 12/1997 | Osawa et al. | 75/255 |
| 5,772,701 | * | 6/1998 | McMillan et al. | 29/25.03 |
| 5,989,492 | * | 11/1999 | Larsson | 419/36 |

* cited by examiner

*Primary Examiner*—Ngoclan Mai
(74) *Attorney, Agent, or Firm*—Thomas J. Monahan

(57) ABSTRACT

A process for sintering green powder metal, metal alloy or metal composition parts employing microwave energy is described.

8 Claims, 7 Drawing Sheets

(3 of 7 Drawing Sheet(s) Filed in Color)

Fe-Cu-C System x170

Green Samples

Fe-Cu-C System x170

Sintered Samples

Fe-Cu-C System x860

Green Samples

Fe-Cu-C System x860

Sintered Samples

Fe-Cu-C System x860

Conventional sintering x860

Microwave sintering x860

Fe–Ni–C System x170

Green Samples

Fe–Ni–C System x170

Sintered Samples

Fe–Ni–C System x345

Green Samples

Fe–Ni–C System x345

Sintered Samples

PROCESS FOR SINTERING POWDER METAL COMPONENTS

This application claims priority to Provisional Application Ser. No. 60/066,947 filed Nov. 25, 1997 entitled "Sintering of Power Metal (PM) Components Using Microwave Energy".

BRIEF DESCRIPTION OF THE INVENTION

This invention relates generally to a process for sintering powder metal parts and more particularly to a process for sintering powder metal parts using microwave energy.

BACKGROUND OF THE INVENTION

Application of microwave energy to process various kinds of materials in an efficient, economic, and effective manner, is emerging as an innovative technology and attracting worldwide attention in academia and industries. Microwave heating of materials is fundamentally different from conventional radiation-conduction-convection heating. In the microwave process, the heat is generated internally within the material instead of originating from external heating sources. Microwave heating is a sensitive function of the material being processed.

Microwaves are electromagnetic radiation with wavelengths ranging from 1 mm to 1 m in free space and frequency between approximately 300 GHz to 300 MHz, respectively. Today microwaves at the 2.45 GHz frequency are used almost universally for industrial and scientific applications.

The microwave sintering of ceramic materials has been investigated for over fifteen years and has many advantages over the conventional methods. Some of these advantages include: time and energy saving, very rapid heating rates (>400° C./min), considerably reduced processing time and temperature, better microstructures and hence improved mechanical properties, environment friendly, etc. The use of microwave processing typically reduces sintering time by a factor of 10 or more. This minimizes grain growth. The fine initial microstructure can be retained without using grain growth inhibitors and hence achieve high mechanical strength. The heating rates for a typical microwave process are high and the overall cycle times are reduced by similar amounts as with the process sintering time, for example from hours/days to minutes. And most importantly, the process is a simple, single step process not involving complex steps of hot isostatic pressing (HIP) or hot pressing. All these possibilities have the potential of greatly improving mechanical properties and the overall performance of the microwave processed components with an auxiliary benefit of low energy usage and cost.

The basic powder metallurgy process is a two step process involving the compaction of a metal powder into the desired shape followed by sintering. Typically metal powders in the range of 1 to 120 micrometers are employed. The powder is placed in a mold and compacted by applying pressure to the mold. The powder compact is porous. Its density depends upon the compaction pressure and the resistance of the particles to deformation.

In the sintering process the powder metal compact is heated to promote bonding of the powder particles. The major purpose of the sintering is to develop strength in the compact. The sintering temperature is such as to cause atomic diffusion and neck formation between the powder particles. The basic process is used in industry for a diversity of products and applications, ranging from catalysts, welding electrodes, explosives and heavy machinery and automotive components.

The most important metal powders in use are: iron and steel, copper, aluminum, nickel, Mo, W, WC, Sn and alloys. The traditional powder metallurgy process is neither energy nor labor intensive, it conserves material and produces high quality components with reproducible properties. However, the challenging demands for new and improved processes and materials of high integrity for advanced engineering applications require innovation and newer technologies. Finer microstructures and near theoretical densities in special components are still elusive and challenging.

While ceramics and certain polymers and elastomers absorb microwave energy partly at low temperatures and increasingly at higher temperatures, by and large it is a universal generalization that good conductors such as metals reflect radiation in this wavelength range and hence cannot absorb energy and be heated by microwaves.

This generalization is borne out by the simple fact that in spite of thousands of studies of microwave heating of food, rubber, polymers, ceramics, etc., no one has ever reported an ordinary commercial powder metal part being sintered by microwave energy. Convincing evidence for this is found in the latest textbook on powder metallurgy (Randall M. German, *Sintering Theory and Practice,* John Wiley, New York, N.Y., 1996), which makes no reference to anyone using microwaves for this task.

The literature reveals the following:

In a paper by Walkiewicz et al. (J. W. Walkiewicz, G. Kazonich, and S. L. McGill, "Microwave heating characteristics of selected minerals and compounds", *Min. Metall. Processing* (February 1988) pp. 39–42), the authors simply exposed 25 g of some 50 powders of reagent grade chemicals, and some 20 natural minerals to a 2.4 GHz field and reported the temperature attained in the crucible in about 10 minutes or less. Among these samples were powders of some half dozen metals (presumably partly oxidized in the air ambient). These showed modest heating (not sintering) in the range from 120° C. (Mg) to 768° C. (Fe). In the paper by M. Willert-Porada, T. Gerdes, K. Rodiger, and H. Kolaska, entitled "Einsatz von Mikrowellen zum Sintern pulvermetallurgischer Prudukte" (*Metall,* 50 (11), pp. 744–752 (1996)), the title of which translates to "Utilization of microwaves for sintering of powder-metallurgical products" the only two categories of "powder-metallurgical products" treated are oxides and tungsten carbide-Co composites ("Hartmetallen" in German). In U.S. Pat. No. 4,147,911 issued Apr. 3, 1979, entitled "Method for Sintering Refractories and an Apparatus Therefor", Nishitani describes a method for sintering of refractories using microwaves. He reports that by adding a few percent of electrically conducting powders such as aluminum, the heating rates of the refractories were considerably enhanced. But in this patent there was no mention of the microwave sintering of pure powders of metals. In a paper entitled "Microwave-assisted solid-state reactions involving metal powders" (A. G. Whittaker and D. M. Mingos, *J. Chem. Soc. Dalton Trans* pp. 2073–2079 (1995)), Whittaker and Mingos reported solid state reaction involving metal powders. They used the high exothermic reaction rates of metal powders with sulfur in microwaves in synthesizing metal sulphides. But no sintering of pure metal or alloy powders is reported in this paper. In a recent textbook on powder metallurgy (Randall M. German, "Sintering Theory and Practice", John Wiley, New York, N.Y. (1996)), the author devotes several pages to microwave heating of oxide and non-oxide ceramics, but makes no reference to anyone using microwave sintering for metals or even suggests that it could work for powdered metals. U.S. Pat. 4,942,278, issued Jul. 17, 1990, entitled "Microwaving of Normally Opaque and Semi-opaque Substances" (Sheinberg et al.) describes the sintering of an oxide-metal composite, basically $Cu_2O$ and Cu using the absorption by the oxide to cause the temperature to rise into the sintering range. Thus neither theory nor empirical evidence from the literature gives one any hint that one can sinter ordinary typical pressed powder green metal compacts as used by the millions in industry.

OBJECTS AND SUMMARY OF THE INVENTION

It is a general object of the present invention to provide an improved process for sintering powder metal parts or components in net shape by heating with microwave energy.

It is a further object of the present invention to provide a method of sintering powder metal parts or components made of Fe, Ni, Co, Cu, Cr, Al, Mo, W, Sn and their alloys using microwave energy.

It is a further object of the present invention to provide a process for sintering powder metal parts and components using microwave energy to provide parts and components which are robust and stable and exhibit better mechanical properties than conventionally made parts and components of the same composition.

It is a further object of the present invention to provide microwave sintered powdered metal parts and components which are dense.

It is a further object of the present invention to provide a process for sintering powder metal parts and components which offers substantially lower costs and significant reduction in energy and time.

The foregoing and other objects of the invention are achieved by a process in which the green powdered metal parts are sintered by the application of microwave energy.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DESCRIPTION OF PREFERRED EMBODIMENT

We have discovered that powder metal parts and components can be sintered by subjecting the parts and components to microwave fields whereby the absorption of microwave energy causes heating and subsequently sintering of the part or component. This is contrary to the general belief that metal reflects microwaves.

We have sintered powder metal green parts comprising various metals and metal alloys to produce sintered parts. In one embodiment, we processed the parts in a controlled atmosphere microwave furnace operated at 2.45 GHz frequency and 6 kW power. Sintering time was between 5 and 60 minutes with sintering temperature between 1100° C. and 1300° C. The temperature was read by optical pyrometers and/or sheathed thermocouples. The atmosphere was flowing forming gas ($N_2$+$H_2$) or pure hydrogen. It was found that the net shape of the green parts was retained precisely and a fine microstructure was produced. In some cases a SiC pre-heater was used to preheat the samples and shorten cycle time. In others the entire heating and sintering was achieved with no pre-heater at all, proving that it is indeed 100% microwave sintering. In alternative embodiments, the powder metal green parts are processed with microwave energy at frequencies between 0.5 GHz and 10 GHz.

EXAMPLE 1

Table 1 below gives data for these microwave experiments and corresponding property values of conventionally made product of the same composition. From this table it is obvious that in almost all cases the Modulus of Rupture (MR) of microwave processed samples was much higher than the conventional samples, in fact in the case of Fe—Ni composition it was 60% higher. The densities of microwave processed samples are also better than conventional samples.

TABLE 1

| Sample | | Sintering Conditions, temp. ° C./time, min. | Sinter Density g/cc | Hardness Rockwell | MR Ksi |
|---|---|---|---|---|---|
| Z64-3806 | MW | 1275/10 | 715 | B82 | 177 |
| (Fe-Ni) | Conv | 1121/30 | 7.10 | B77 | 109 |
| Z34-3603 | MW | 1180/10 | 7.17 | B96 | 142 |
| (Fe-Cu) | Conv | 1121/30 | 6.84 | B80 | 118 |
| Z02-3803 | MW | 1275/10 | 7.09 | B22 | 182 |
| | Conv | 1254/30 | 7.0 | B36 | 161 |
| Z91-8604 | MW | 1180/10 | 6.90 | B88 | 146 |
| | Conv | 1121/30 | 6.90 | B96 | 145 |

MW: Microwave processed
Conv: Conventionally processed

EXAMPLE 2

Samples with composition of Fe+Cu(2%)+Graphite(0.8%) were microwave processed at 1200° C. for 30 minutes. The sintered and green samples were characterized for their microstructure by SEM and phase composition by X-ray diffractomertry.

Figure 1A:
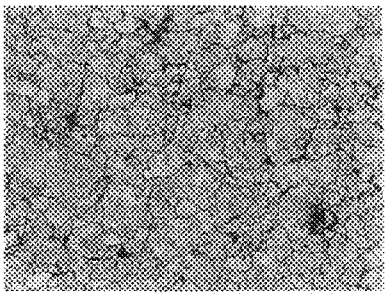
FIGS. 1A and 1B are scanning electron micrographs of a green metal powder part.
Figure 1C:
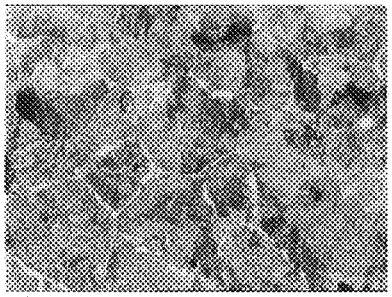
FIGS. 1C and 1D are scanning electron micrographs of the sintered part of metal powders shown in FIGS. 1A and 1B.
Figure 1B:
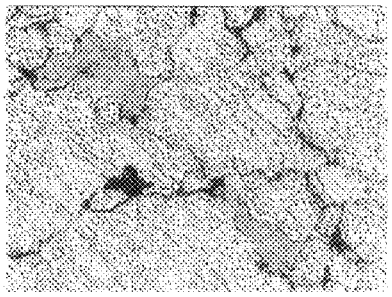
Figure 1D:
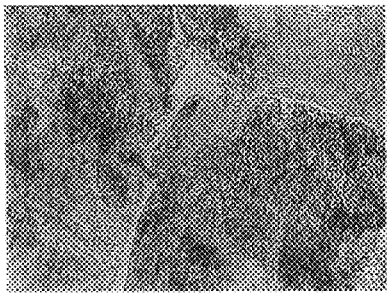
Figure 2A:
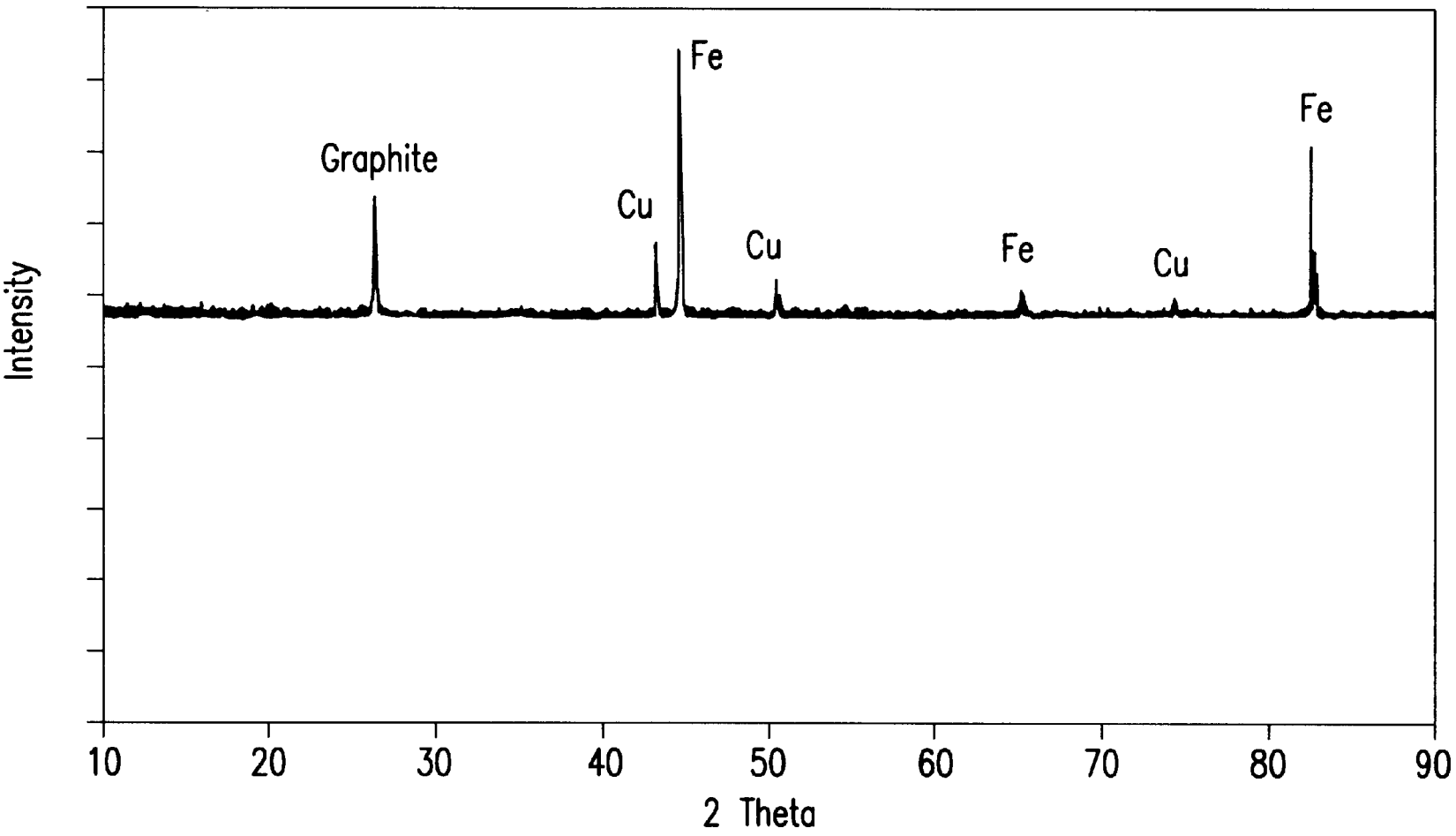
FIGS. 2A and 2B are X-ray diffractograms of the material shown in FIGS. 1A and 1B and 1C and 1D respectively.
Figure 2B:
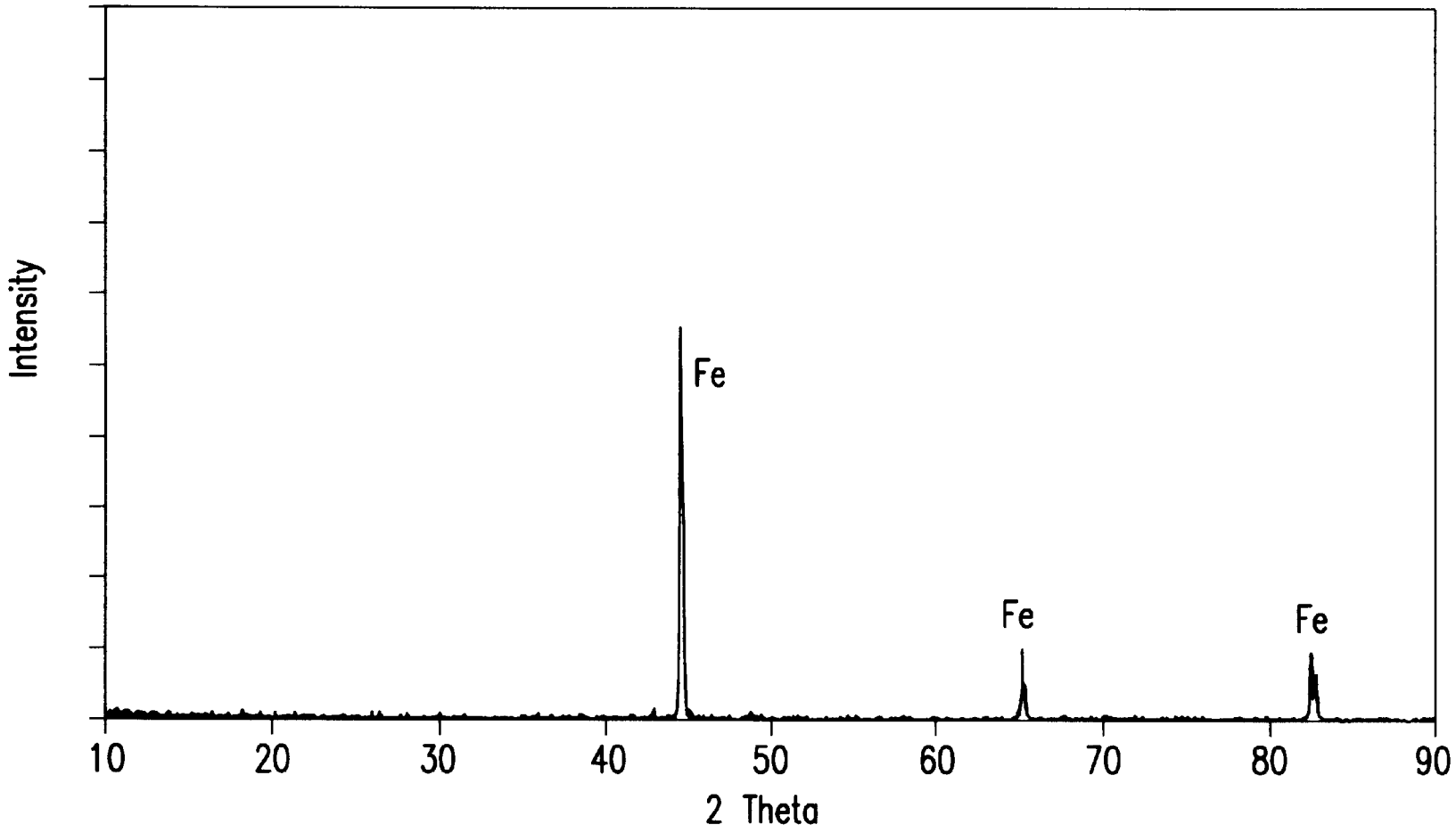

The scanning electron micrographs of the green and microwave sintered samples are shown at FIGS. 1A and 1B for 170 and 860 magnification before sintering and 1C and 1D at 170 and 860 magnification after sintering. These micrographs indicated that excellent sinterability had occurred between iron particles. The copper melted and reacted with iron particles forming Fe—Cu solid solutions. The X-ray diffractogram, FIG. 2A, indicates that the green pellet contained separate components of the original mixture. The sintered sample had only one phase showing α-iron peaks solid solution with Cu), FIG. 2B.

EXAMPLE 3

Cobalt metal powder was pressed into pellets and microwave sintered in pure H2 at 1 atmosphere pressure at various temperature ranging from 900° C. to 1200° C. for 10 minutes. Fully dense samples were obtained at 1100° C. The table below gives the sintering conditions and density data of the microwave sintered Co samples.

TABLE 2

| Sintering Temp. ° C. | Sintering Time, min. | Density, g/cc |
|---|---|---|
| 900 | 10 | 8.70 |
| 1000 | 10 | 8.88 |
| 1050 | 10 | 8.88 |
| 1100 | 10 | 8.89 |
| 1150 | 10 | 8.89 |
| 1200 | 10 | 8.89 |

EXAMPLE 4

Figure 3A:
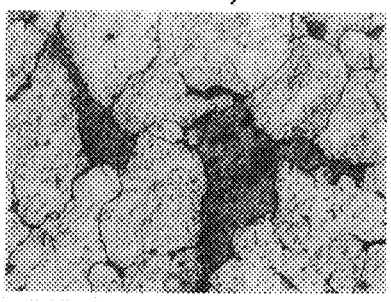
FIGS. 3A, 3B and 3C show the microstructures of a green Fe+Cu(2%)+graphite(0.8%) part, the conventionally sintered part, and the microwave sintered part, respectively.
Figure 3B:
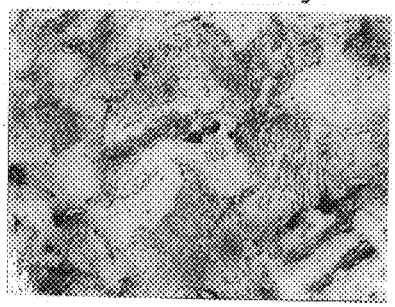
Figure 3C:
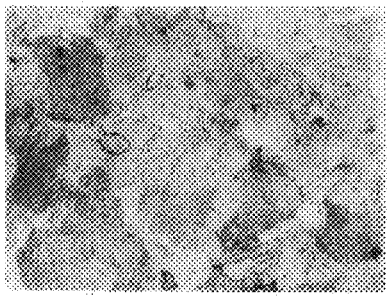
Figure 4A:
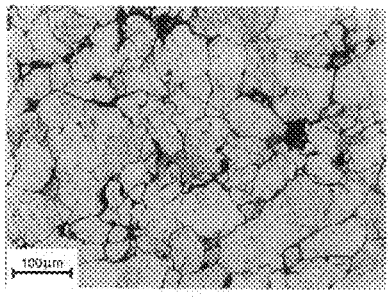
FIGS. 4A, 4B and FIGS. 4C, 4D show the microstructures of a green Fe+Ni(2%)+graphite(0.8%) and the microwave sintered part, respectively.
Figure 4C:
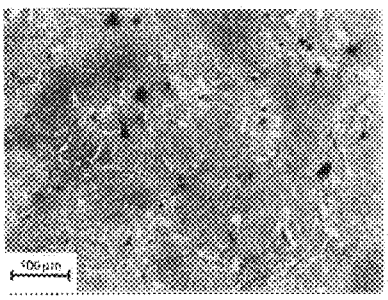
Figure 4B:
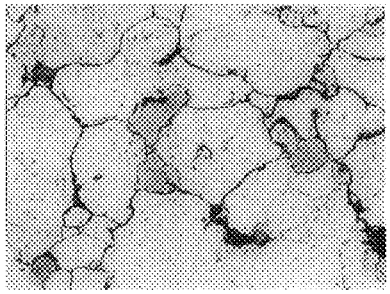
Figure 4D:
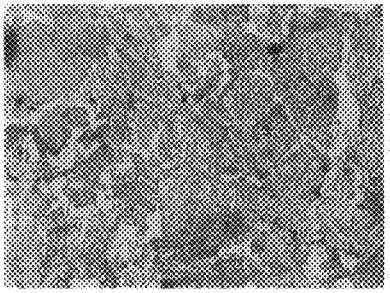
Figure 5A:
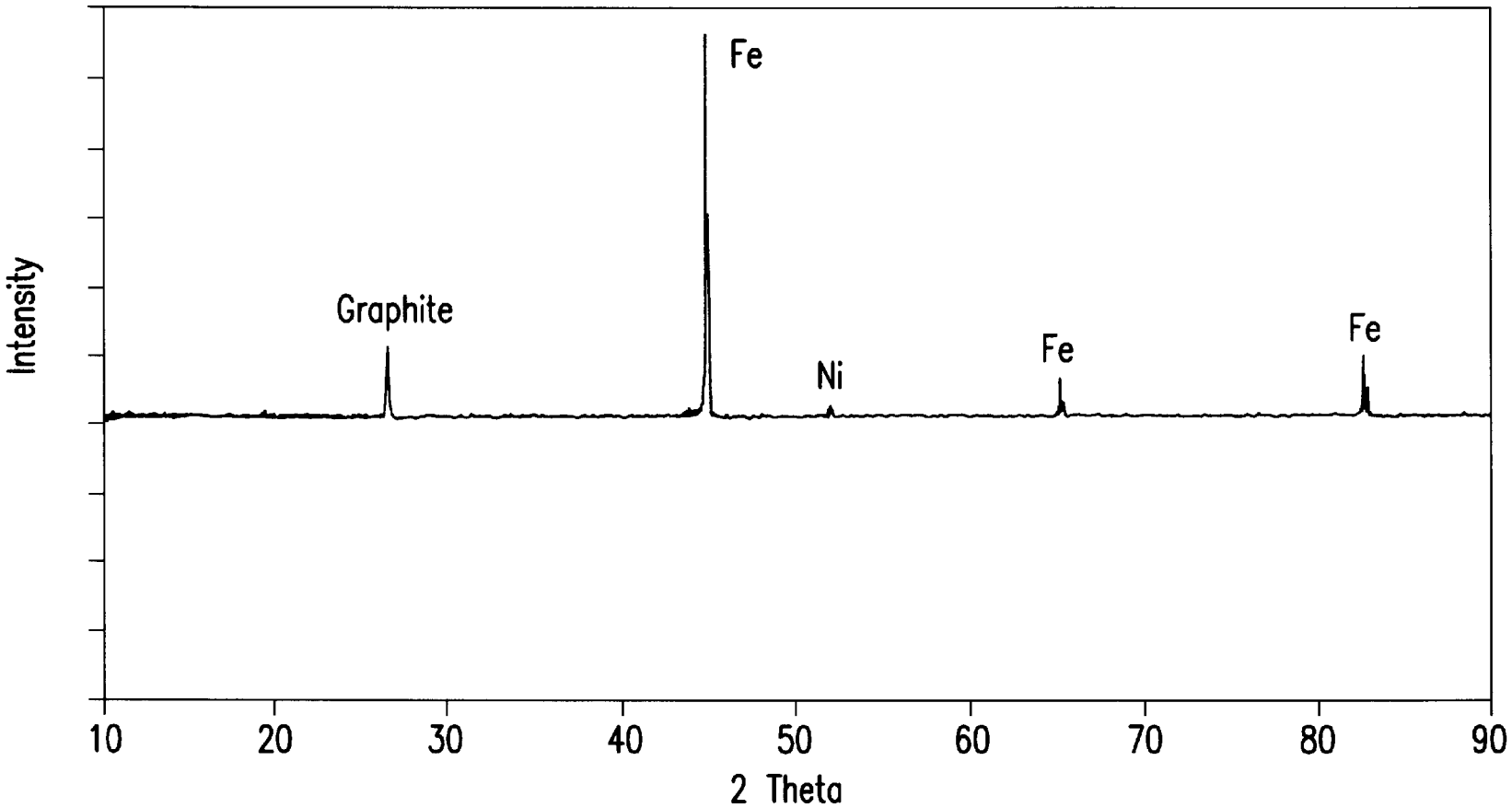
FIGS. 5A and 5B show the X-ray diffractograms of the material shown in FIG. 4 before and after sintering, respectively.
Figure 5B:
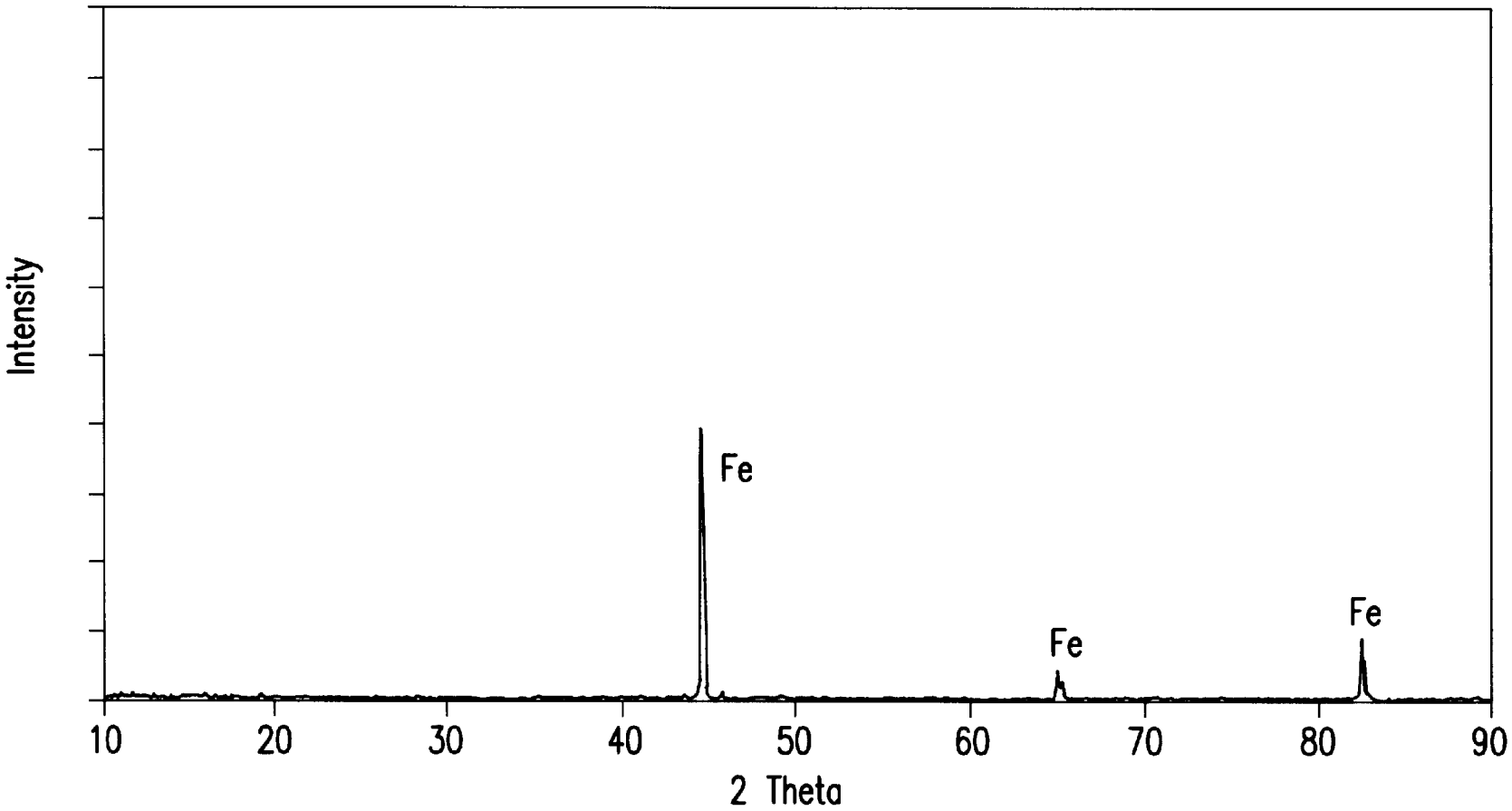

Green samples Fe+Cu(2%)+graphite(0.8%) and Fe+Ni (2%)+graphite(0.8%) were sintered at 1120° C. for 30 minutes. FIGS. 3A, 3B and 3C show the microstructures (examined by an optical microscope) of green, conventionally sintered and microwave sintered Fe+Cu(2%)+graphite (0.8%). FIGS. 4A and 4B show the microstructures for green and sintered Fe=Ni(2%)+graphite(0.8%), respectively. It is seen that in FIGS. 3A and 4A, 4B, that all graphite is concentrated between grains. FIGS. 3B and 3C show that the copper is dissolved in the iron and a pearlitic structure is formed. FIGS. 4C, 4D show austenitic nickel-rich islands and some pearlite. FIGS. 5A and 5B show X-ray diffractograms of green and sintered samples, respectively, in the Fe—Ni—C system. The X-ray diffractogram of the green pellet shows existence of Fe, Ni and graphite phases in the original mixture. The X-ray diffractogram of a microwave sintered pellet indicates dissolution of Ni and C in the iron.

EXAMPLE 5

The table below lists the transverse rupture data of the conventionally and microwaved sintered samples of the Fe=Ni(2%)+graphite(0.8%) sintered at 1250° C. for 30 minutes. This clearly shows that the microwaved processed powdered metal part has a 20% higher strength.

TABLE 3

| | Conventional | Microwave |
|---|---|---|
| TRS (MPa) | 885<br>869 | 1064<br>1037 |

The process of sintering with microwave energy can be carried out with the amount of various phases in the alloy system varying from 10 to 100% by microwave sintering to produce multiphase alloys far from equilibrium.

Thus there has been provided a process for sintering powder metal parts and components which is efficient, economical, environmentally friendly, reduces processing times and provides a better microstructure with improved mechanical properties.

The foregoing description, for purposes of explanation, used specific nomenclature to provide a thorough understanding of the invention. However, it will be apparent to one skilled in the art that the specific details are not required in order to practice the invention. The descriptions of specific examples are presented for purposes of illustration. They are not intended to be exhaustive or to limit the invention. Metal powder compositions and variations are possible in view of the above teachings. The examples were chosen in order to best explain the principles of the invention and its practical applications, to thereby enable others skilled in the art to best utilize the invention. It is intended that the scope of the invention be defined by the following claims and their equivalents.

What is claimed is:

1. The method of sintering a powder metal green part which comprises powder metal, a powder metal alloy, or a powder metal composition, by subjecting it to microwave energy for a predetermined time to form a dense metal part wherein the microwave energy has a frequency between 0.5 GHz and 10 GHz.

2. The method of sintering a powder metal green part which comprises powder metal, a powder metal alloy, or a powder metal composition, by subjecting it to microwave energy for a predetermined time wherein the microwave frequency is 2.45 GHz and the time is less than 1 hour.

3. The method of sintering a green part as in claim 1 or 2 in which the metal powder is selected from the group: Fe, Ni, Co, Cu, Cr, Al, Mo, W, Sn and their alloys.

4. The method of sintering a powder metal part as in claim 1 in which the powder metal composition comprises powders of two or more metals whereby they react to form multiphasic alloys.

5. The method of sintering a powder metal green part having the metal composition Fe—Ni, with or without carbon, by subjecting it to microwave energy for a predetermined time to form a dense metal part wherein the microwave energy has a frequency between 0.5 GHz and 10 GHz.

6. The method of sintering a powder metal green part having the metal composition Fe+Cu, with or without carbon, by subjecting it to microwave energy for a predetermined time to form a dense metal part wherein the microwave energy has a frequency between 0.5 GHz and 10 GHz.

7. The method of sintering a powder metal green part having the metal composition Fe+Cu.(2%)+Graphite(0.8%), by subjecting it to microwave energy for between 10 and 30 minutes at a temperature between 1100° C. and 1250° C. to form a dense metal part wherein the microwave energy has a frequency between 0.5 GHz and 10 GHz.

8. The method of sintering a powder metal green part of cobalt by subjecting it to microwave energy for approximately ten minutes at approximately 1100° C. to form a dense metal part wherein the microwave energy has a frequency between 0.5 GHz and 10 GHz.

* * * * *